US005259437A

United States Patent [19]

Jarry

[11] Patent Number: 5,259,437

[45] Date of Patent: Nov. 9, 1993

[54] METHOD OF OBTAINING BIMATERIAL PARTS BY MOULDING

[75] Inventor: Philippe Jarry, Grenoble, France

[73] Assignee: Pechiney Recherche, Courbevoie, France

[21] Appl. No.: 737,022

[22] Filed: Jul. 29, 1991

[30] Foreign Application Priority Data

Jul. 31, 1990 [FR] France ..... 90 10224

[51] Int. Cl.[5] ..... B22D 19/00

[52] U.S. Cl. ..... 164/100; 164/98

[58] Field of Search ..... 164/98, 100, 101, 97, 164/91, 102

[56] References Cited

U.S. PATENT DOCUMENTS

| | | | |
|---|---|---|---|
| 3,038,248 | 6/1962 | Kremer | 164/98 |
| 3,720,257 | 3/1973 | Beutler | 164/100 |
| 3,945,423 | 3/1976 | Hannig | 164/100 |
| 4,102,033 | 7/1978 | Emi | 164/100 |
| 4,643,241 | 2/1987 | Yonekura | 164/101 |
| 4,687,043 | 8/1987 | Weiss | 164/97 |
| 4,715,178 | 12/1987 | Tsukuda | 164/98 |
| 4,997,024 | 3/1991 | Cole | 164/98 |

FOREIGN PATENT DOCUMENTS

| | | | |
|---|---|---|---|
| 62-173065 | 7/1987 | Japan | 164/100 |
| 63-56345 | 3/1988 | Japan | 164/100 |
| 64-75161 | 3/1989 | Japan | 164/101 |
| 1-289560 | 11/1989 | Japan | 164/100 |
| 526445 | 12/1974 | U.S.S.R. | 164/98 |
| 2194277 | 3/1988 | United Kingdom | 164/100 |

*Primary Examiner*—Mark Rosenbaum
*Assistant Examiner*—Rex E. Pelto
*Attorney, Agent, or Firm*—Dennison, Meserole, Pollack & Scheiner

[57] ABSTRACT

The disclosure relates to a method of obtaining, by moulding, bimaterial parts formed by two aluminium alloys one of which constitutes the core and the other the matrix. The method consists in using a core, optionally containing a refractory skeleton, removing a natural coating of alumina present on the surface of the core and immediately afterwards coating the assembly thus obtained with a film impermeable to gas and consisting of a metal such as nickel, placing the coated assembly in a mould which is filled with the alloy of the matrix in the molten state at a temperature such that at least 30% of the core is superficially remelted. The method can be applied to the manufacture of motor vehicle parts such as engine cylinder heads and the insertion of ducts into aeronautical parts.

16 Claims, 1 Drawing Sheet

METHOD OF OBTAINING BIMATERIAL PARTS BY MOULDING

BACKGROUND OF THE INVENTION

The present invention relates to a method of obtaining bimaterial parts by moulding.

More particularly, it relates to parts which consist of a core of aluminium alloy inserted into a matrix of another aluminium alloy.

This particular structure is used for example for making up motor vehicle parts such as cylinder heads in order locally to modify their properties and to incorporate channels into aeronautical parts which are produced by moulding.

Indeed, it is known that such parts are, in use, subjected to localised and particular stresses, especially heat-related stresses, and that to avoid certain unfortunate repercussions on their behaviour, general practice is to resort to incorporate into the parts inserts having properties which respond more satisfactorily to these stresses than does the basic material.

However, it has been found that the production of these bimaterial parts posed problems, particularly with regard to the connection between the insert and the matrix.

Indeed, on the one hand, adhesion between the constituents of the parts is not always suitable and then inadequate mechanical or physical properties (such as heat conductivity for example) result; on the other hand, as moulding is performed with a metal in the molten state by filling a mould in which the insert has been placed, if the metal forming the insert has a melting temperature below or close to that of the moulding metal, this can cause a deformation of the insert prejudicial to the correct positioning of the insert.

That is why the Applicants, aware of the interest which bimaterial parts offer and of the problems which arise when producing such parts, have sought and found a solution which constitutes the substance of the present invention.

SUMMARY OF THE INVENTION

The invention thus consists of a method of obtaining by moulding bimaterial parts consisting of a core of an aluminium alloy inserted into a matrix of another aluminium alloy, characterised in that the natural coating of alumina present on the surface of the core is removed, the core then being coated immediately afterwards with a film impermeable to gases, of a metal having a free oxide-forming energy in excess of −500 kJ/mole of oxygen between the ambient and 1000 K., having a melting temperature greater than those of the core and of the matrix, being soluble in liquid aluminium and forming a eutectic with aluminium, the coated core is placed in a mould which is filled with the alloy of the matrix in the molten state at such a temperature that at least 30% of the core is remelted superficially.

Thus, the first characteristic feature of the invention resides in removing the natural coating of alumina which is inevitably present on the surface of the alloy forming the core. This may be achieved by basic or acid pickling. This operation makes it possible to remove the main obstacle to the establishment of a metallurgical bond between the components of the part and should be carried out immediately prior to carrying out the next to avoid formation of a fresh coating of alumina.

The second characteristic feature of the invention is coating of the core in a film impermeable to gas in order to avoid its becoming oxidised in course of time. This film consists of a metal having a free oxide formation energy greater than −500 kJ/mole of oxygen between the ambient and 1000 K. in order to be sufficiently resistant to oxidation. This metal must be soluble in aluminium in order to allow the establishment of metallurgical continuity between the core and the matrix at the moment of casting. Likewise, it should have a melting temperature above those of the core and of the matrix to ensure its protecting the insert against oxidation until such time as it is dissolved. The object of this film is to replace the coating of alumina always present on the surface of the insert and which constitutes an obstacle to the establishment of a bond with the matrix, a metallic coating having greater affinity for liquid aluminium alloys.

The third characteristic feature of the invention resides in placing the coated core in a mould and filling the mould with the alloy of the matrix in the molten state at such a temperature that the thermal balance of the casting operation results in a superficial remelting of the core by at least 30%.

The combination of these characteristic features finally results in the metallurgical continuity desired and makes it possible to achieve bonding levels of between 90 and 100%.

However, under these conditions, if the metal forming the insert has a temperature below or close to that of the moulding metal, deformation of the insert cannot be prevented and this is prejudicial to its correct positioning. That is why in this case the invention likewise consists of using a core containing a dispersion of refractory products.

These refractory products have the task of forming a kind of skeleton which preserves the integrity of the shape of the insert throughout casting of the matrix. Indeed, although the insert is partially remelted, as the skeleton consists of a refractory material, that is to say a material which will not melt under the casting conditions, it will allow the insert to retain its initial form. Furthermore, it is possible to take advantage of the improvement in mechanical properties and dimensional stability provided by the presence of the skeleton in the aluminium alloy, advantages which are abundantly described in the literature.

This skeleton may be constituted by any refractory ceramic material whether it be in the form of fibres or particles, normally used with aluminium alloys and preferably alumina. Preferably, its geometry is similar to that of the insert so that a preform can be produced. In volume, it represents a proportion comprised between 5 and 60% in relation to the alloy used for the core; a lesser proportion makes it difficult to produce the preform while a greater proportion constitutes a limit to the compaction of the fibres by a conventional preform manufacturing process.

Nevertheless, the best results are obtained when the volumetric fraction is comprised between 10 and 40%.

The alloy pairings used in the invention are such that at a temperature corresponding to the 30% partial refusion of the core, the alloy of the matrix is itself totally liquid. Preferably, alloys in the 200 series according to the Standards of the Aluminium Association, are used for the core while series 300 and 6000, according to the same Standards, are used for the matrix. Examples which may be quoted are alloy 204.2, otherwise referred to as A-U5GT (an aluminium alloy mainly containing by weight 4.2–4.9% copper, 0.2–0.35% magnesium, 0.15–0.25% titanium) would be suitable for the core and for the matrix either the alloy B380 still according to French AFNOR standards referred to as A-S9U3 (an aluminium alloy containing approx. 9% silicon, approx. 3% copper) or alloys A356 and A357 corresponding to the A-S7G according to AFNOR (aluminium alloys containing by weight approx. 7% silicon, approx. 0.3% or 0.7% magnesium) or even alloy 6061.

Moulding is generally carried out in a sand or metal mould by gravity under low pressure, under pressure or using the lost wax technique.

Also preferably, the metals which are most suitable for producing the film are either nickel, cobalt, silver or gold.

To be sufficiently sealing-tight, the film is preferably between 0.5 and 5 μm thick. However, better results are obtained in the thickness range comprised between 1 and 2 μm. Beyond 5 μm, the thickness is too great and means that dissolution of the film in the matrix becomes too slow.

With regard to the nickel, it has been found that the best method of obtaining a correct coating consisted of a chemical deposition process always preceded by scouring and pickling to remove the oxide coating.

Under these conditions, the coating behaves well vis-à-vis corrosion; it has a covering power which makes it possible to obtain an even deposition whatever the form of the part being treated; it adheres well to metal substrates and may be even improved by a heat treatment.

Furthermore, it adheres perfectly well to the fibres which appear on or close to the surface.

DESCRIPTION OF THE PREFERRED EMBODIMENTS

Figure 1:
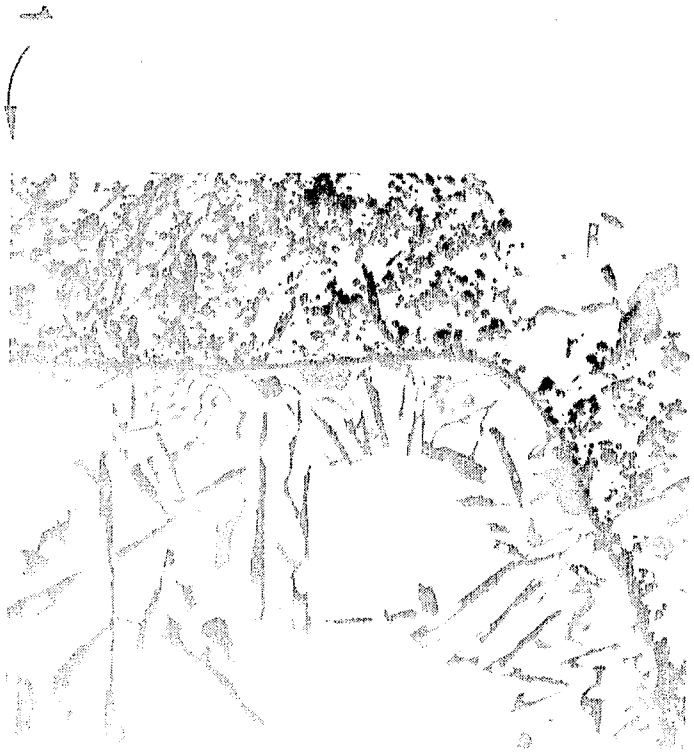
FIG. 1 is a photomicrograph of a part obtained according to the prior art.
Figure 2:
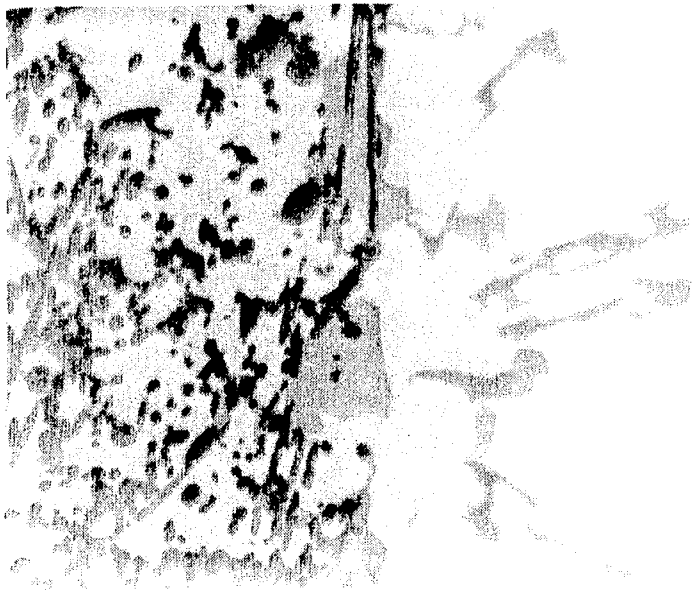
FIG. 2 is a photomicrograph of a part obtained according to the invention.

The invention may be illustrated with the help of FIGS. 1 and 2 attached which represent photomicrographs of parts obtained respectively according to the prior art and according to the invention. These parts were produced from an insert of alloy A204.2 (A-U5GT) reinforced with 20% by volume alumina fibres (brand name SAFFIL) having a length of a few tens of microns and a matrix of alloy B380 (A-S9U3). The insert in the part shown in FIG. 2 has been coated with a film of nickel 2 μm thick before moulding of the matrix.

The photomicrograph in FIG. 1 shows between the insert and the matrix a discontinuity represented by the curved line 1 while on the photomicrograph in FIG. 2 the bond is perfect between the insert and the matrix.

The invention will be applied particularly to the manufacture of inter-valve bridging pieces on cylinder heads of new generation turbo-diesel engines and the insertion of complexly shaped ducting into moulded parts for aeronautical applications.

What is claimed is:

1. A method of obtaining, by moulding, bimaterial parts comprising a core comprising an aluminum alloy inserted into a matrix of another aluminum alloy, comprising the steps of: removing a natural surface coating of alumina present on the surface of the core; immediately afterwards coating the core with a film impermeable to gases, said coating being of a metal having a free oxide-forming energy in excess of −500 kj/mole of oxygen between room temperature and 1000 K. and having a melting temperature greater than those of the core and of the matrix and being soluble in liquid aluminum and forming an eutectic with aluminum; placing the coated core in a mould; and filling the mould with the alloy of the matrix in the molten state at such a temperature that at least 30% of the core is remelted.

2. A method according to claim 1 wherein said core contains a refractory skeleton comprising fibers or particles of refractory material.

3. A method according to claim 1 wherein the alloys used for the matrix are selected from the group consisting of the 300 and the 6000 series according to the Standards of the Aluminum Association.

4. A method according to claim 3 wherein the alloy is selected from the group consisting of A351, A356, B380 and AA6061 alloys.

5. A method according to claim 1 wherein the alloy used for the core is selected from the 200 series according to the Standards of the Aluminium Association.

6. A method according to claim 5 wherein the alloy is A204.2.

7. A method according to claim 2 wherein the core comprises an alumina based fibrous refractory product.

8. A method according to claim 2 wherein the core comprises between 5 and 60% by volume of refractory fibers.

9. A method according to claim 8 wherein the volumetric proportion of fibers is between 10 and 40%.

10. A method according to claim 1 wherein the metal forming the film is nickel.

11. A method according to claim 1 wherein the metal forming the film is cobalt.

12. A method according to claim 1 wherein the metal forming the film is silver.

13. A method according to claim 1 wherein the metal forming the film is gold.

14. A method according to claim 1 wherein the film has thickness between 0.5 μm and 5 μm.

15. A method according to claim 13 wherein the film has a thickness between 1 and 2 μm.

16. A method according to claim 10 wherein the nickel film is formed by a chemical process.

* * * * *